US005746606A

United States Patent [19]

Sobhani

[11] Patent Number: 5,746,606

[45] Date of Patent: May 5, 1998

[54] SPRING LOADED CONTACT DEVICE AND ROTARY CONNECTOR

[75] Inventor: Mohi Sobhani, Encino, Calif.

[73] Assignee: Hughes Electronics, Los Angeles, Calif.

[21] Appl. No.: 724,591

[22] Filed: Sep. 30, 1996

[51] Int. Cl.[6] ..... H01R 39/00

[52] U.S. Cl. ..... 439/21; 439/700

[58] Field of Search ..... 439/700, 824, 439/20–22, 27, 29, 30, 67, 77, 492

[56] References Cited

U.S. PATENT DOCUMENTS

| | | | |
|---|---|---|---|
| 3,356,806 | 12/1967 | Urani | 439/824 |
| 3,439,307 | 4/1969 | Ruscher | 439/8 |
| 3,594,680 | 7/1971 | Bushborn | 439/8 |
| 5,154,628 | 10/1992 | Skegin | 439/700 |
| 5,417,595 | 5/1995 | Cullen et al. | 439/700 |
| 5,458,509 | 10/1995 | Hiraoka et al. | 439/700 |

FOREIGN PATENT DOCUMENTS

| | | | |
|---|---|---|---|
| 0109670 | 4/1989 | Japan | 439/824 |

*Primary Examiner*—Neil Abrams
*Assistant Examiner*—Katrina Davis
*Attorney, Agent, or Firm*—Leonard A. Alkov; William C. Schubert; Glenn H. Lenzen, Jr.

[57] ABSTRACT

A spring loaded contact device having a housing with an internal bore, a spring disposed in the bore, a pin disposed in and extending from the bore, and a dimple formed in the housing that secures the pin in the bore. A first portion of the pin contacts the spring, a center portion of the pin is smaller than the first portion and protrudes from the bore, and a head of the pin is disposed external to the bore and has a rounded cylindrical end. A rotary connector using the spring loaded contact devices has first and second printed wiring boards that rotate relative to each other that are electrically interconnected using a plurality of spring loaded contact devices disposed on the first printed wiring board. The spring-loaded contact devices are used to transfer electrical signals or power to conductive contacts formed on the second printed wiring board.

4 Claims, 1 Drawing Sheet

SPRING LOADED CONTACT DEVICE AND ROTARY CONNECTOR

BACKGROUND OF THE INVENTION

The present invention generally relates to rotary connectors, and more particularly, to an improved spring loaded contact device and spring loaded rotary connector having rotatable printed wiring boards electrically interconnected by a plurality of the spring loaded contact devices that slide on conductive traces.

The purpose of a rotary connector is to transmit power or signals from a stationary object to a moving or rotating object. A conventional slip ring connector is a very fragile device. Conventional slip rings are impractical and very vulnerable to road hazards for use in automobile and transportation vehicles. In harsh environments, such as those encountered in aircraft and vehicular use, such slip ring connectors often fail due to the fragile nature of brushes and rings used therein. Conventional wire wrap connectors are used that exhibit very high failure rates.

U.S. patent application Ser. 08/680,075, filed Jul. 15, 1996, entitled "Spring Loaded Rotary Connector" assigned to the assignee of the present invention, discloses a spring loaded rotary connector having rotatable printed wiring boards electrically interconnected by a plurality of spring loaded plungers that slide on metal tracks. While conceptually simple, the design of the spring loaded contact devices is extremely important so that optimal contact is achieved between them and the metal tracks formed on the rotatable printed wiring boards. Proper design is required to produce a long life connector that is reliable and operates smoothly under varying loading conditions.

Therefore, it is an objective of the present invention to provide for an improved spring loaded contact device and spring loaded rotary connector having rotatable printed wiring boards with conductive traces that are electrically interconnected by means of a plurality of the spring loaded contact devices.

SUMMARY OF THE INVENTION

In order to meet the above and other objectives, the present invention provides for an improved spring loaded contact device and spring loaded rotary connector employing same. The spring loaded contact device has a housing with an internal bore, a spring disposed in the bore, a pin disposed in and extending from the bore, and a dimple formed in the housing that secures the pin in the bore. A first portion of the pin contacts the spring, a center portion of the pin is smaller than the first portion and protrudes from the bore, and a head of the pin is disposed external to the bore and has a rounded cylindrical end.

The spring loaded contact device is optimally designed for use in constructing a spring loaded connector having a plurality of printed wiring boards that rotate relative to each other that are electrically interconnected using a plurality of the spring loaded contact devices. The spring loaded contact devices are disposed on one printed wiring board and transfer electrical signals or power to metallized contacts or conductive traces formed on a second printed wiring board. The spring loaded contact devices are very rugged and provide for a rotary connector having long life. The spring loaded contact devices are sandwiched and sealed between the printed wiring boards and can withstand harsh highway or outdoor environments.

The spring loaded contact devices and conductive traces on the printed wiring boards provide for a rotary connector that is used to transmit power or signals from a stationary object to a moving object. Rotary connectors employing the spring loaded contact devices may be used to replace slip-ring type connectors currently used in many aircraft and vehicle applications. The spring loaded contact devices make the spring loaded rotary connector very rugged and it is reliable in harsh outdoor environments. Two rotary connectors using the present spring loaded contact devices have been built and tested on an auto axle and have met all expectations. The present invention may be used in rotary connectors designed for use in cars, trucks, motor homes, motorcycles, and aircraft, and wherever rotary electrical connectors may be employed.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DESCRIPTION OF THE PREFERRED EMBODIMENTS

Figure 1:
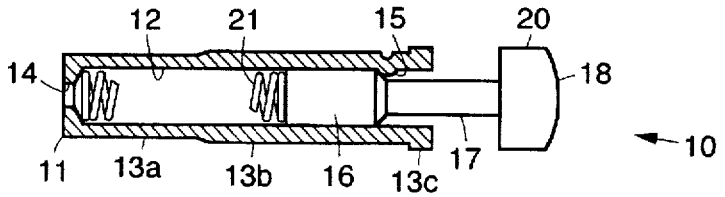
FIG. 1 is a cross sectional view of a spring loaded contact device in accordance with the principles of the present invention.

Referring to the drawing figures, FIG. 1 is a cross sectional view of a spring loaded contact device 10 in accordance with the principles of the present invention. The spring loaded contact device 10 comprises a cylindrical housing 11 having an internal bore 12 and a closed first end with a hole 14 therethrough. The housing 11 has a first diameter 13*a* adjacent the first end for a portion (about one-third) of the length of the housing 11, and a slightly larger diameter 13*b* for substantially the remainder of the housing 11, and a lip 13*c* formed at a second or opposite end of the housing 11 from the first end. A spring 21 is disposed in the bore 12 which has one end disposed adjacent the hole 14 in the housing 11.

Figure 2:
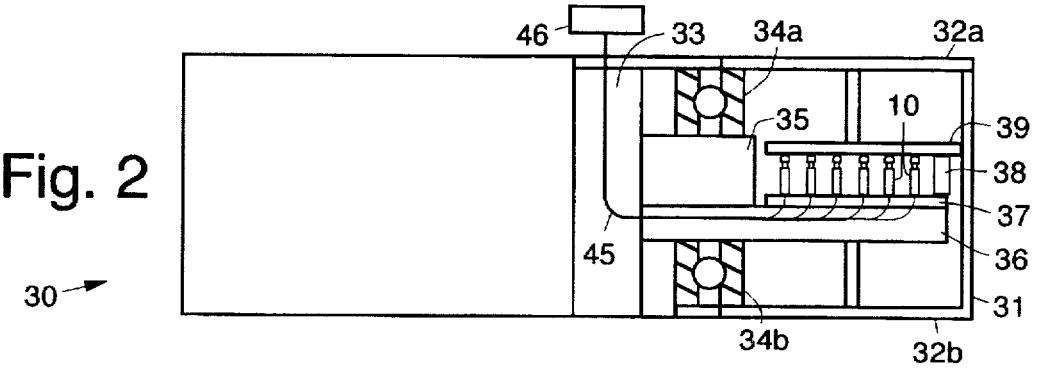
FIG. 2 illustrates a cross sectional side view of a spring loaded rotary connector employing a plurality of spring loaded contact devices shown in FIG. 1.
Figure 3:
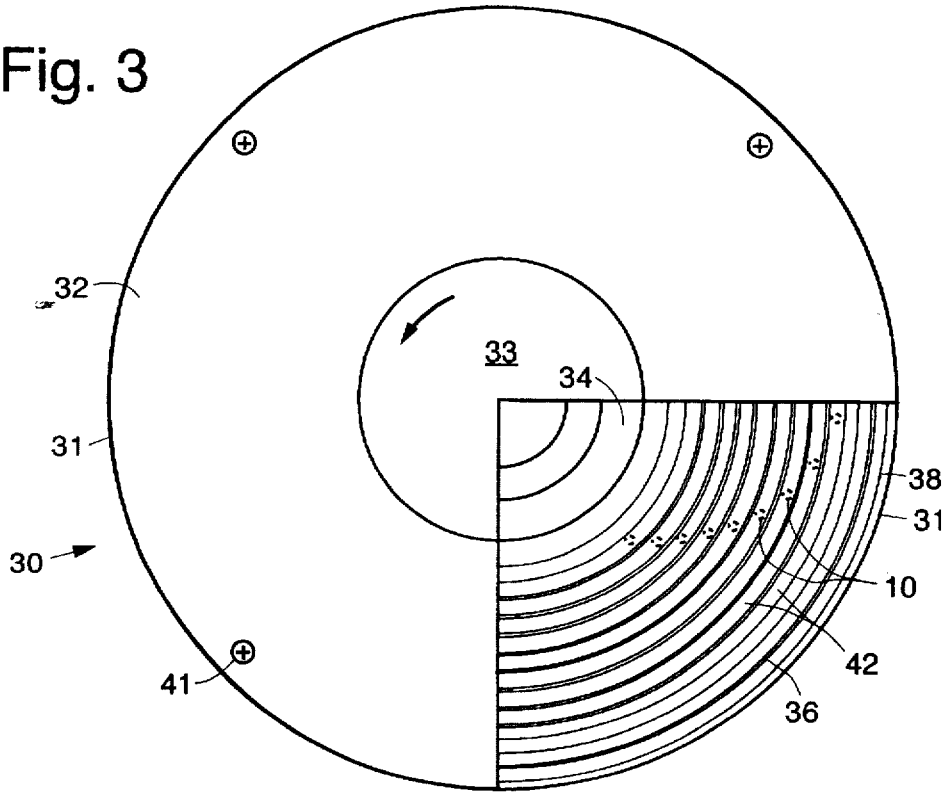
FIG. 3 illustrates a bottom view of a spring loaded rotary connector shown in FIG. 2.
Figure 4:
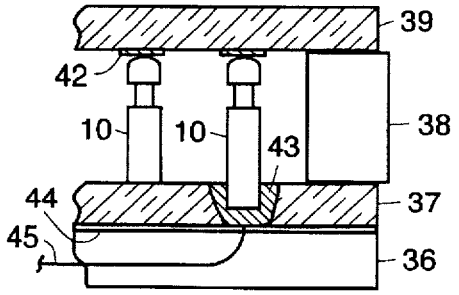
FIG. 4 illustrates an enlarged view of a portion of the spring loaded rotary connector of FIG. 2.

A pin 20 is disposed in the bore 12 and has a cylindrical portion 16 that is disposed in the bore 12 and contacts the second end of the spring 21. The pin 20 has a center portion 17 that is smaller in diameter than the first portion 16. The pin 20 is tapered between the first and second portions 16, 17. A dimple 15 is formed in the housing 11 that secures the pin 20 in the bore 12. The pin has a head 18 that has a cylindrical shape that is rounded at its end. The head 18 of the pin 20 is designed to ride on metal traces formed on a printed wiring board as shown in FIGS. 2–4. The spring loaded contact device 10 is designed so that it is extremely long wearing and resilient. The components of the spring loaded contact device 10 may be formed from brass, beryllium copper or preferably high purity gold, such as from a material known as exotic gold, manufactured by Ny Corporation, for example.

Thus, in its simplest form, the spring loaded contact device 10 comprises a housing 11 having an internal bore 12, a spring 21 disposed in the bore 12, a pin 20 disposed in and extending from the bore 12, and a dimple 15 formed in the housing 11 that secures the first portion 16 of the pin 20 in the bore 12. The first portion 16 of the pin 20 contacts the spring 21, the center portion 17 of the pin 20 is smaller than the first portion 16 and protrudes from the bore 12, and the head 18 of the pin 20 is disposed external to the bore 12 and has a rounded cylindrical end.

In a reduced to practice embodiment of the spring loaded contact device 10, it had a fully extended length of 0.220 inches, the first diameter 13*a* of the housing 11 was 0.035 inches, the slightly larger diameter 13*b* was 0.037 inches, the lip 13*c* and head 18 had diameter of 0.040 inches, the length of the housing 11 was 0.160 inches, the diameter of the hole 14 was 0.010 inches, the head 18 had a length of 0.030 inches, and the head 18 had a curved contact surface with a radius of 0.032 inches. The pin 20 had a travel of 0.030 inches. The housing 11, spring 21, and pin 20 were made from exotic gold to provide a spring loaded contact device 10 having excellent electrical conductivity.

FIG. 2 illustrates a cross sectional side view of a spring-loaded rotary connector 30 employing a plurality of spring loaded contact devices 10 shown in FIG. 1. FIG. 3 illustrates a bottom view of a spring-loaded rotary connector 30 of FIG. 2. FIG. 4 illustrates an enlarged view of a portion of the spring loaded rotary connector 30 of FIG. 2. The spring-loaded rotary connector 30 is illustrated with reference to its use in a shaft-type application, wherein its rotatable components are coupled to a shaft 33 that rotates relative to a fixed enclosure 31. However, it is to be understood that the connector 30 may be designed so that the enclosure 31 rotates relative to a fixed shaft 33.

The exemplary rotary connector 30 is comprised of a enclosure 31 having first and second covers 32*a*, 32*b* that may be secured to the enclosure 31 by means of a plurality of screws 41, for example. A rotatable shaft 33 is disposed through the center of the enclosure 31, and a disk 36 and collar 35 extend radially outward from the shaft 33. First and second bearings 34*a*, 34*b* are coupled to the shaft 33 on opposite sides of the disk 36 and the collar 35. The first and second covers 32*a*, 32*b* secure outer races of the bearings 34*a*, 34*b*. Thus the shaft 33, disk 36, and collar 35 rotate with respect to the enclosure 31 and covers 32*a*, 32*b*.

Referring to FIGS. 2 and 4, a first printed wiring board 37 is secured to the disk 36 by means of adhesive 44, such as a thin layer of double sided adhesive tape 44, for example. The first printed wiring board 37 has a plurality of conductive traces 43 or contacts 43 that are connected to a plurality of spring loaded contact devices 10. The spring loaded contact devices 10 may be secured in a plurality of plated holes, for example, formed in the first printed wiring board 37. The plurality conductive traces 43 or contacts 43 are connected (such as by soldering) by way of a plurality of wires 45 to a connector 46. The plurality of spring loaded contact devices 10 contact a corresponding plurality of electrically isolated conductive traces 42 disposed on a second printed wiring board 39. The second printed wiring board 39 is secured to the enclosure 31. The plurality of electrically isolated conductive traces 42 are typically connected to a sensor or other device (not shown). A spacer 38 is disposed between the first and second printed wiring boards 37, 39. The spacer 38 is used to control the amount of deflection of the first and second printed wiring boards 37, 39, and hence the amount of deflection of the spring-loaded rotary connector 30.

As should be readily apparent, the spring loaded contact devices 10 slide on the conductive traces 42 when the first printed wiring board 37 rotates with respect to the second printed wiring board 39. The rotation of the shaft 33 relative to the enclosure 31 is represented by the arrow in FIG. 3. Consequently, electrical signals are transferred from the first printed wiring board 37 to the second printed wiring board 39 by way of the spring loaded contact devices 10 and the conductive traces 42 on the second printed wiring board 39.

The spring-loaded rotary connector 30 permits relative angular movement between the shaft 33 and the enclosure 31 that secures the second printed wiring board 39. The spring-loaded rotary connector 30 also compensates for movement between the first and second printed wiring boards 37, 39 in terms of their separation distance. More specifically, if the respective planes of the first and second printed wiring boards 37, 39 are not parallel, then the pins 20 of the spring loaded contact devices 10 adjust for the differences in distance therebetween. This may be caused by vibration of a vehicle, for example, or relative movement between the components that are connected to the shaft 33 and the enclosure 31 to which the second printed wiring board 39 is secured. This might be the relative movement between an axle and a wheel of a vehicle, for example. The relative motion is compensated for by the rounded shape of the heads 18 of the spring loaded contact devices 10 which operate to keep electrical contact with the respective conductive traces 42 irrespective of the relative angular relationship between the first and second printed wiring boards 37, 39.

The rotary connector 10 is shown as comprising flat printed wiring boards 37, 39 that are designed to engage the shaft 11. However, it is to be understood that contoured printed wiring boards 37, 39 such as may be provided by cylindrical or spherical printed wiring boards 37, 39, for example, may be employed as well as flat printed wiring boards 37, 39. Therefore, the connector 30 is not limited to a flat configuration.

The spring loaded contact devices 10 and the rotary connector 30 employing same have been designed to withstand harsh outdoor environments such as when the connector 30 is used in conjunction with axles of automobiles and trucks, for example. The rotary connector 30 may be used to transmit power or signals from a stationary object to a moving object. The rotary connector 30 has been developed to replace existing slip-ring type connectors conventionally used in many aircraft and vehicle applications. The spring loaded rotary connector 30 is rugged and performs well in harsh outdoor environments. Two connectors 30 have been built and tested on an auto axle, and have performed well. The spring loaded contact devices 10 and the rotary connector 30 in which they are employed may be used in cars, trucks, motor homes, motorcycles, and aircraft, wherever rotary electrical connectors are used.

Thus, an improved spring loaded contact device and spring-loaded rotary connector have been described. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A spring loaded contact device for use in a spring-loaded rotary connector between a fixed component and a rotating component, said spring loaded contact device comprising:

a housing having a first end, a second end, and an internal bore wherein the housing has a first diameter adjacent to the first end thereof for a portion of the length of the housing and a slightly larger diameter for substantially the remainder of the housing and a lip formed at the second end of the housing a spring disposed in the bore wherein the spring has a first end directly contacting the first end of the housing and a second end;

a pin having a first portion disposed in the bore that contacts the second end of the spring, a center portion that is smaller than the first portion and that protrudes from the bore wherein the pin is tapered between the first portion and the center portion, and a head disposed external to the bore that has a rounded cylindrical end;

a dimple formed in the housing that secures the first portion of the pin in the bore.

2. The device of claim 1 wherein the housing, spring, and pin comprise brass.

3. The device of claim 1 wherein the housing, spring, and pin comprise beryllium copper.

4. The device of claim 1 wherein the housing, spring, and pin comprise high purity gold.

* * * * *